US007987624B1

(12) United States Patent
Möller et al.

(10) Patent No.: US 7,987,624 B1
(45) Date of Patent: Aug. 2, 2011

(54) FLASHLESS ELECTRIC FIREARM AND AMMUNITION THEREFOR

(76) Inventors: Tilo Möller, Oberndorf (DE); Rudolf Brandl, Weiden (DE); Alex Seidel, Oberndorf (DE)

( * ) Notice: Subject to any disclaimer, the term of this patent is extended or adjusted under 35 U.S.C. 154(b) by 0 days.

(21) Appl. No.: 05/057,868

(22) Filed: Jul. 14, 1982

(51) Int. Cl.

| | |
|---|---|
| ***F41A 19/58*** | (2006.01) |
| ***F41A 19/69*** | (2006.01) |
| ***F41A 21/02*** | (2006.01) |
| ***F41A 21/34*** | (2006.01) |
| ***F41A 21/46*** | (2006.01) |
| ***F41A 21/48*** | (2006.01) |
| ***F41A 35/04*** | (2006.01) |

(52) U.S. Cl. ..... 42/76.01; 42/76.02; 42/77; 42/84; 42/96; 42/106; 89/14.2; 89/16; 89/28.05

(58) Field of Classification Search ..... 42/76 R, 42/76 A, 78, 84, 1 R, 1 A, 1 L, 76.02, 77, 42/96, 106; 102/93, DIG. 7, 14.2, 16, 28.05; 89/14, 68, 522

See application file for complete search history.

(56) References Cited

U.S. PATENT DOCUMENTS

| | | | | | |
|---|---|---|---|---|---|
| 127,849 | A | * | 6/1872 | Colvin | 42/78 |
| 1,416,828 | A | * | 5/1922 | Holmes | 89/14 SB |
| 2,381,547 | A | * | 8/1945 | Leininger | 42/84 |
| 2,820,412 | A | * | 1/1958 | Beeuwkes, Jr. et al. | 102/93 |
| 2,911,911 | A | * | 11/1959 | White | 102/93 |
| 3,212,208 | A | * | 10/1965 | Persechino et al. | 42/76 R |
| 3,298,279 | A | * | 1/1967 | Barnet et al. | 42/76 A |
| 3,340,769 | A | * | 9/1967 | Waser | 89/14 SB |
| 3,453,763 | A | * | 7/1969 | Barr et al. | 42/1 L |
| 3,505,927 | A | * | 4/1970 | Driscoll | 42/84 |
| 3,585,934 | A | * | 6/1971 | Mueller et al. | 42/1 L |

* cited by examiner

*Primary Examiner* — Michael Carone

(74) *Attorney, Agent, or Firm* — Venable LLP; Jeffri A. Kaminski

(57) ABSTRACT

A substantially noiseless firearm and ammunition therefor, in which the projectile of the ammunition is attached to the front end of a sabot which fills the cross-sectional area of the barrel and is fired with the projectile. The barrel is provided with lands designed to catch the sabot at the front end of the barrel in such manner that the barrel is sealed off in a gas-proof fashion by the sabot.

24 Claims, 2 Drawing Sheets

FLASHLESS ELECTRIC FIREARM AND AMMUNITION THEREFOR

BACKGROUND OF THE INVENTION

For a long time, endeavors have been made in the technical world to develop firearms which produce as little sound as possible when being fired. Through these efforts, silencers were developed which actually were pressure-relief devices for the powder gases, being of variable length, and frequently divided into various segments, such silencers to be screwed onto the front end of the barrel. By means of these silencers, it is true, the sound level of the bang can be considerably reduced; however, the sound level of the bang is by far above that of the general noise level so that the firing of a weapon can distinctly be heard even from a large distance. In addition, the size and the weight of small arms is considerably increased by such silencers, which applies particularly to hand-held weapons where the length of the silencer can considerably exceed the length of the barrel so that the total length of the weapon is more than double the length of the weapon itself.

The requirement for a weapon which produces as little sound as possible is not satisfied by compressed air weapons since these compressed air weapons also produce a considerable sound when fired, and since, furthermore, the projectiles do not have sufficient penetration.

In view of these facts, the invention is concerned with the problem of creating small arms, and particularly a pistol with associated ammunition, which practically do not produce any perceivable sound when fired, without the necessity of extending its barrel by a silencer, or of rendering the weapon difficult to handle for other reasons.

SUMMARY OF THE INVENTION

In accordance with the invention, this problem is solved in such a manner that the projectile of the ammunition designated for such small arms is attached to the front end of a sabot filling in the cross-sectional area of the barrel which is fired together with the projectile, and that, furthermore, the barrel is provided with lands which are designed to catch the sabot at the front end of the barrel in such a manner that the barrel is sealed off in a gas-proof fashion by the sabot.

With the small arm of the invention, the formation of a bang which is caused by the powder gases escaping from the barrel from behind the projectile and depressurizing, is not reduced by a slow relief of pressure of these gases, but completely eliminated by the fact that the retention of the sabot at the front end of the barrel prevents the gases from escaping from the barrel at all. In this surprisingly simple manner, it is possible to suppress completely the bang occasioned by the powder gases, and thus a practically soundless small arm can be created if, for the purpose of suppressing the projectile bang, the muzzle velocity is limited to a value below the speed of sound.

With a preferred embodiment of the invention, the barrel of the small arm is equipped, at its front end, with a collar extending into the interior of the barrel which reduces the muzzle diameter as compared to that of the rest of the barrel, and the projectile is designed as a subcaliber projectile which is capable of passing through the muzzle with a certain play. A guide element associated with the projectile then forms a sabot which is caught by the collar at the front end of the barrel after a round has been fired. This embodiment of the invention is distinguished by a very simple structure.

The sabot for the projectile can be formed as a graduated element, and can be provided with a front cylindrical section which fits into the muzzle delimited by the collar, and, furthermore, with a rear section engaging in the grooves of the barrel. In addition, a center section can be provided which approximately equals the cross-sectional area of the barrel defined by the lands. In this manner, the sabot, on the one hand, is given the desired spin, and, on the other hand, a particularly satisfactory obturating of the muzzle of the barrel is achieved.

The ammunition for the weapon of the invention can also be shaped very simply since no special cartridge casings are required; rather, the sabot itself can be provided with a cavity and receive, in place of a cartridge casing, the propellant charge and the igniter cap. The sabot may be formed of plastic, and the projectile can be cemented onto the front face of the sabot. It is also feasible, however, to provide the sabot with a cavity at its front end as well, and to insert the projectile into the sabot. If a sabot is to be used which comprises plastic, it is particularly practical if the barrel is equipped with grooves with arched bases and adjacent grooves to meet with sharp edges since, in this manner, the edges of the grooves impress themselves particularly well on the soft sabot and this eliminates any danger that any grooves are skipped.

In order to muffle the firing bang, it has furthermore been found to be practical to attach a gas permeable plate in front of the muzzle which is penetrated by the projectile only after the sabot has been caught at the front end of the barrel. This plate, which preferably is formed of felt, muffles the sound which can possibly be caused when the sabot is caught at the front end of the barrel.

The muzzle of the barrel is preferably covered by a thin, detachable plastic foil which can, for instance, be attached to the outer surface of a plate keeping the porous plate in place and serves the purpose of preventing any contaminating agents, and particularly water, from entering into the barrel. In this manner, it is possible to utilize the firearm of the invention even immediately after it has been submerged in water so that this firearm, for instance, represents a suitable arm for frog men. The foil has to be stripped off manually before the firearm is fired in order to prevent it from causing any compression of air in the barrel which could cause a bang.

It is understood that the firearm of the invention cannot be designed as an automatic weapon even though the possibility of reloading has not been precluded. It is, however, practical to design a small arm, in accordance with the invention, as a multi-barrel weapon and/or develop the barrel, or barrels, of this weapon, together with the inserted cartridges, in such a manner that it/they can be exchanged. In this manner, it is possible without any difficulty also to attain considerable fire power when using the firearm of the invention. Thus, for instance, several barrels can be joined together as a cylinder which can be exchanged as a structural unit.

With a preferred embodiment of the invention, the cylinder preferably is formed of plastic and is provided, on a circle which is concentrically located with its axis, with equally distributed axially parallel bores into which the barrels equipped with the cartridges are inserted, and in which they are kept in place between terminal discs which are counter-rigged by means of a tension rod, the front disc of which, at the same time, serves as the collar delimiting the muzzle. Preferably, the cylinder is provided with a fixation bar at its base which bar can be pressed into a corresponding groove of a grip, and can be locked therein. In order to keep the weight of such a cylinder as low as possible, the barrels may be formed of fiber glass-reinforced plastic. The stability of this type of fiber glass-reinforced plastic is sufficient to give the projectile the desired alignment. In addition, the tension rod can be designed as a sighting tube which not only facilitates a particularly rapid and relatively accurate sighting, but also serves the purpose of eliminating obstructive protrusions on the firearm as are formed, for instance, by the front and rear sights.

In further development of the invention, a small arm of this type can be designed with electrical priming, and its trigger can be designed as an electrical switch by means of which a battery installed in the grip of the weapon can be brought into electrical contact with the igniter cap of the cartridge. The application of such an electrical priming offers the advantage that all sounds are also eliminated which could be caused by a firing mechanism, and particularly by the impact of a hammer on the firing pin, or the impact of the firing pin. In addition, electrical priming has the advantage that, by means of suitable electrical installations, several barrels can consecutively be fired without the necessity of mechanically moving the barrels, or the priming mechanism. In addition, jamming cannot occur in cases where a barrel is not ignited since, in such cases, it is possible to switch over to the subsequent barrel. Should an electrical priming device be applied, the ammunition has to be provided with known igniter caps suited for this purpose.

With a preferred embodiment of the invention which is equipped with an exchangeable rotary cylinder, the terminal disc which is conductively connected with the tension rod can preferably be provided with bores in the area around the igniter caps. Such bores are aligned with bores in the terminal disc in which contact pins engage which pins are attached to the grip. That end of the tension rod which protrudes beyond the rear terminal disc is then provided with a collar which engages in a mating contact of the grip. In addition, the contact pins are, in each instance, individually connected with one each of several switches which can individually, or successively, be closed in order to select the barrel to be fired. It is particularly practical if an active connection can be established between the trigger and a rotary control which is advanced by one contact every time an activation occurs so that the barrels are automatically fired successively. A very simple combination of a trigger with a rotary control which requires little space can be developed in such a manner that the trigger is formed by a control which can be moved in its longitudinal direction inside a casing, which control is installed in such a manner, with projections attached to its circumference engaging in elongated slots of the casing, that it cannot be rotated, and is equipped, at its face, with control paths interacting with control paths provided at the face of the casing in order to rotate an actuator seated on the edge of the bolt by a certain angle every time the bolt is suppressed, and, at the same time, to press the actuator against a contact plate in order to effect an electrical connection. An arrangement of this type is quite similar to the pressure mechanism which is known to be used with ball-point pens, is very simple as far as its structure is concerned, and is, at the same time, absolutely reliable with respect to its function. Such apparatus is disclosed in the copending application of Rudolf A. Brandi, Ser. No. 57,869, and filed of even date herewith, entitled "Electrical Switch For Firearms".

The above-described arrangement also provides a very simple way of putting the firearm on "safe" by utilizing a safety shaft. With a preferred embodiment of the invention, the safety shaft is not only brought into contact with the bolt but also with the fixation bar which is attached to the base of the cylinder. In one position, it releases the bolt, and in a different position, the fixation bar. In the center position, both elements are arrested so that the barrels are kept in place and the firearm is put on "safe" at the same time.

In order to provide a possibility for the rifleman to make sure at any time whether the firearm is ready to fire, and that no failures can occur due to the fact that the battery is run down, a control lamp can be installed in the grip of the weapon which can be connected, by way of a parallel connection, with the battery in order to check its state of charge. With a preferred embodiment of the invention, the control light is installed in the grip in such a manner that it can be moved in its longitudinal direction, can be pressed into the grip against the force of a spring, and can thus, for the purpose of turning it on, be applied to charged contacts.

Further details and explanations regarding the invention can be obtained from the following presentation in which the invention is described and explained in further detail by means of the embodiment shown in the drawing. The characteristics which can be inferred from the description, and the drawing, can be applied with other embodiments of the invention either individually, or as a random combination of several characteristics. The presentations show the following:

Figure 1:
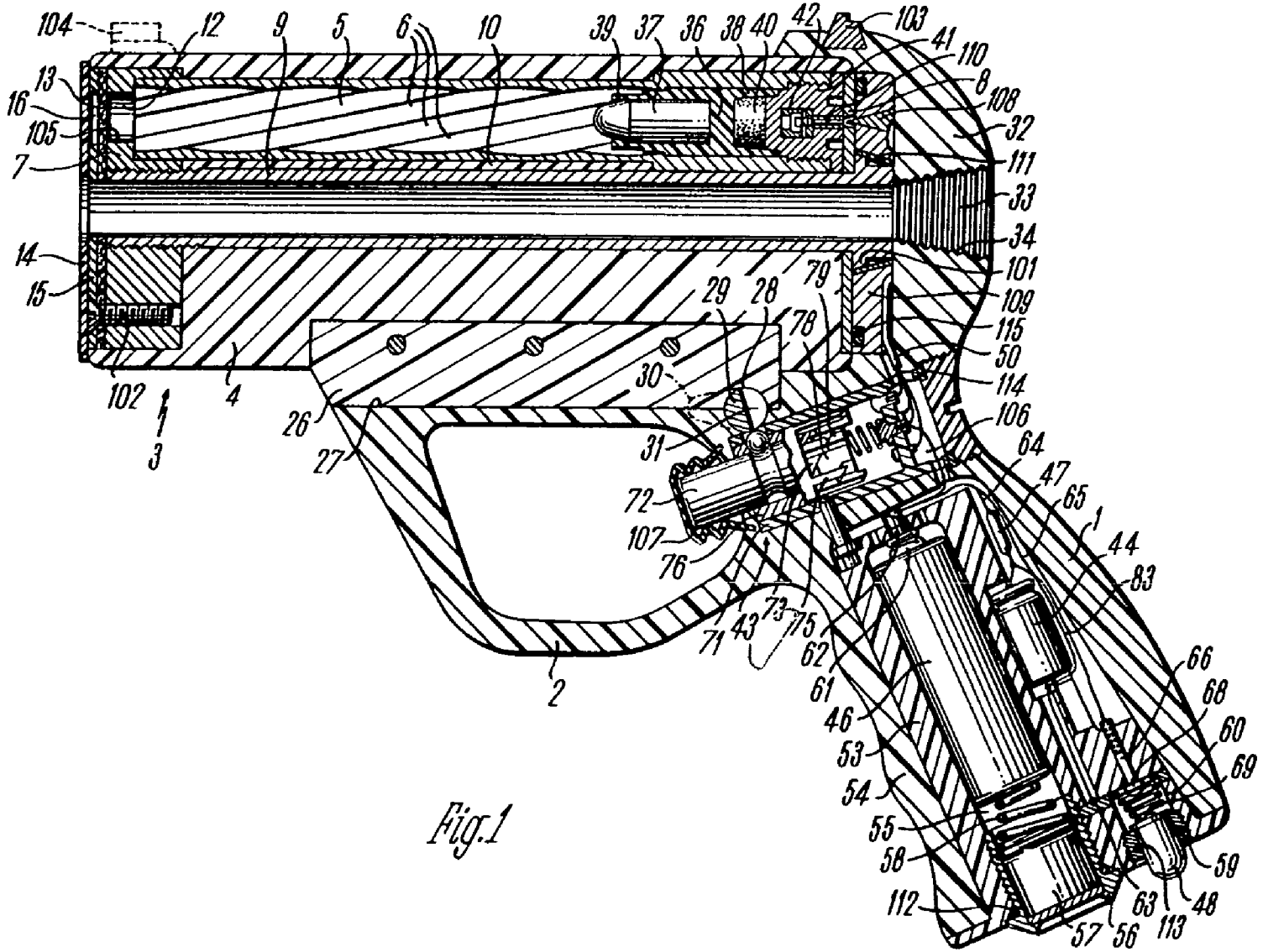
FIG. 1 illustrates a longitudinal cross-section of a firearm in accordance with the invention.

The pistol shown in the drawing is equipped with a grip 1 with trigger guard 2, and a rotary cylinder 3, which is detachably affixed to the grip 1. The rotary cylinder 3 is formed by a cylinder 4 which may be formed of plastic and is provided, on a circle concentric with its axis, with five equally distributed axially parallel bores into which the barrels 5 are inserted. The barrels 5 are provided with grooves 6 and can, as is customary, be formed of steel. It is also possible, however, to use other metals, or even fiber glass-reinforced plastic. The utilization of fiber glass-reinforced plastic has the advantage that in this manner the weight of the cylinder, and thus of the weapon itself, is considerably reduced.

The barrels 5 are kept in place in the bores of the cylinder 4 by terminal discs 7 and 8 which are inserted in corresponding bores at the ends of the cylinder and are counter-rigged to the core 10 of the cylinder by means of a tension rod 9. The front end of the tension rod 9 is indented into a corresponding taphole of the front terminal disc and, with a collar 101, bears against the rear surface of the rear terminal disc 8. The front terminal disc 7 is equipped, as an extension of the barrels 5, with muzzles formed by bores which have a smaller diameter than the barrels 5. Furthermore, a gas permeable plate 13 which consists of felt is installed in front of the front terminal disc 7, which plate is kept in place by a clamping plate 15 closing off the cylinder in the front. The clamping plate 15 is kept in place by means of screws 102 which are strained into the front terminal disc 7, and is provided with bores 16 which are aligned with the muzzles 12 in the front terminal disc and have a slightly larger diameter than these muzzles. A plastic foil 14 has been cemented onto the outer surface of the clamping plate which foil tightly closes off the barrels 5 from the front end, and which preferably should be individually detachable in order to provide the possibility to expose one barrel after the next for firing purposes.

The rotary cylinder 3 is equipped, at its base, with a fixation bar 26 in order to facilitate attachment to the grip 1. Bar 26 is inserted in a groove 27 of the grip 1 provided above the trigger guard and is equipped, at its rear, with an approximately semicircular transverse slot 28 in which a section of the safety shaft 29 inserted in the grip 1 engages for the purpose of fixing the bar 26 in the grip. By turning the safety shaft, by means of the safety catch 30 which is indicated by a dot-dash line in the drawing, by 180 degrees, a recess 31 with which the safety shaft is provided approaches the area around the fixation bar 26 so that the fixation bar can be moved in the groove 27 in order to facilitate insertion or removal of the rotary cylinder 3.

The rotary cylinder 3 inserted in the grip engages, as indicated in FIG. 1, in a cover-type section 32 of the grip 1 with its rear end which section is provided, in the center, with a bore 33 opening like a cone to the rear which bore is aligned with the rear of the tension rod 9 designed as a tube. In connection with the bore 33, the tension rod 9 forms a sighting device by which the installation of the rear sight 103 and the front sight 104, as indicated in FIG. 1, is made unnecessary which is desirable as these sights otherwise form obstructive protrusions. In order to prevent blinding reflections, the inner surface of the bore 33 is provided with annular grooves 34.

With the pistol shown as an embodiment, every barrel 5 of the rotary cylinder 3 is provided with a cartridge. This cartridge consists of a sabot 36 and a projectile 37 which is inserted into a bore of the sabot from the front. In place of this arrangement, the projectile can also be cemented to the front face of the sabot. Preferably, a heavy metal is used for the projectile 37 in order to give the projectile, despite its relatively low muzzle velocity, a high penetration. The projectile 37 is subcaliber, i.e. its diameter is smaller than that of the barrel 5, and it is shaped in such a manner that it fits through the muzzle 12 in the front terminal disc 7 with a certain play. The sabot, however, fills in the cross-sectional area of the barrel, and its rear section 38 is proportioned in such a manner as to impress itself on the grooves 6 of the barrel so that it receives a spin which is, in turn, imparted to the projectile 37. The diameter of the front section 39 of the sabot 36 is such that it impresses itself on the muzzle 12 after the weapon has been fired, and thus effects a tight obturation of the front end of the barrel when the subsequent section of the sabot 36 is brought to bear on the collar 105 formed by the edge of the muzzle 12, and is thus caught. The projectile 37 is so deeply inserted in the sabot that it penetrates the gas permeable plate 13 only after the sabot has been caught by the collar 105, and after the projectile 37 has been released from the sabot 36 so that this plate absorbs the sound which might be caused through the impact of the sabot 36 on the collar 105. The sabot 36 should preferably consist of a relatively soft material, such as, for instance, plastic as is the case with the embodiment presented. In this case, a cross-sectional area of the barrel should preferably be selected where the lands 6 are equipped with an arched base, and where adjacent lands meet with sharp edges so that these edges can satisfactorily impress themselves on the relatively soft sabot and impart to it the desired spin.

In addition, the sabot, at the same time, is assigned the task of functioning as a cartridge casing of regular ammunition. For this purpose, its rear section 38 is equipped with a cavity and filled with a powder charge 40. The space receiving the powder charge which is open to the rear is closed off by a metal plug 41 which is screwed into the barrel 5 from behind, and is equipped, in the center, with an igniter cap 42. Since the pistol is designed for electrical priming, the igniter cap 42 contains a priming substance which can be ignited by applying a voltage to the center or the edge of the igniter cap which, in turn, ignites the powder charge 40 contained in the sabot 36.

Figure 3:
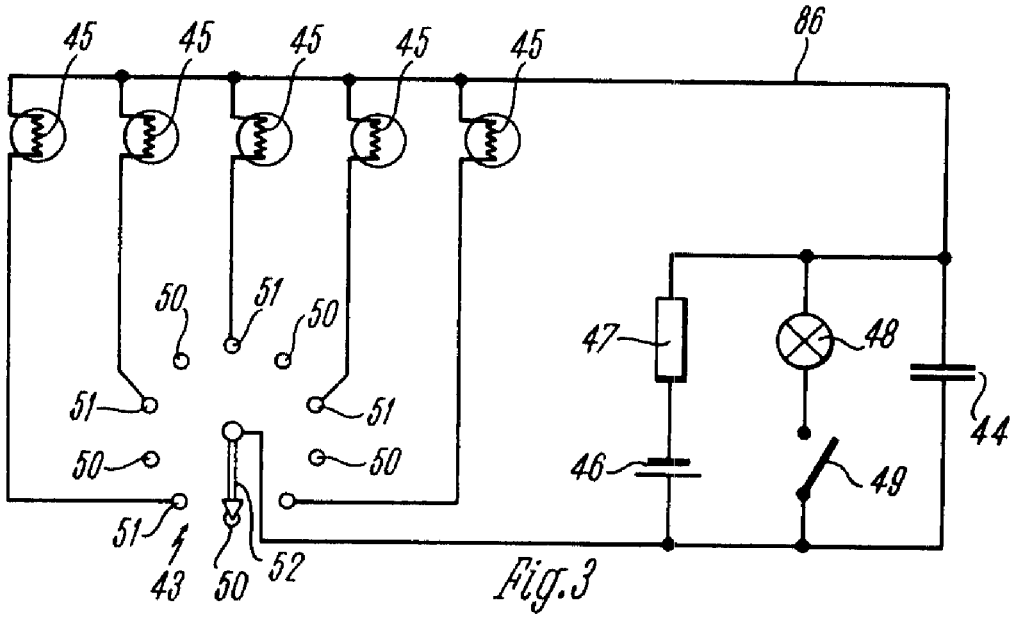
FIG. 3 is a wiring diagram of the electrical trigger mechanism.

The wiring diagram of the electrical priming mechanism of the pistol is illustrated in FIG. 3. This priming mechanism is equipped with a switch 43 by means of which a capacitor 44 can successively be applied to the igniter caps of the cartridges contained in the barrels 5, which caps are designed as resistors. The capacitor 44 is charged through a battery 46 via a quenching resistor 47. A control light 48 can be connected, by way of a parallel connection, with the capacitor by means of a switch 49, and provides the possibility to check whether the state of charge of the capacitor 44 ensures an accurate priming of the igniter caps, or whether the battery 46 is already too much run down to ensure a sufficient charging of the capacitor 44 and thus an accurate priming of the cartridges.

As can be seen, the switch 43 serving as a trigger has a total of 10 positions, i.e. five rest positions 50, and 5 priming positions 51. Every time the trigger 43 is activated, the setting contact 52 is, in each instance, advanced from its rest position 50 to the subsequent priming position 51 so that a cartridge is ignited, after which the setting contact 52 advances to the subsequent rest position 50 after the trigger has been released. This procedure is repeated every time the trigger is activated until all five cartridges have been fired and the rotary cylinder 3 has to be exchanged for a new one if further rounds are to be fired.

As can be seen from FIGS. 1 and 2, battery 46 is installed in an insert 53 comprising an insulating material, which insert has been placed into the handle 54 of the grip 1 from below. The battery is kept in place in a longitudinal bore 55 of the insert 53 by a screwed plug 56 which also serves the purpose of receiving a silica gel capsule. By means of a conical spiral spring 58 provided between the base of the battery 46 and the screwed plug 56, a conductive contact is established between one of the poles of the battery 46 and the screwed plug 56. Next to the screwed plug 56, another screwed plug 59 is located in which the control light 48 is positioned in such a manner that it can be moved in its longitudinal direction against the force of another conical spiral spring 60. The base of the control light 48 is conductively connected with a contact bridge 63, via the screwed plug 59 and the conical spiral spring 60, which connects the first screwed plug 56 and the inner end of the conical spiral spring 60.

The pole 61 which is located at the other end of the battery is applied to a contact rivet 62 which is installed at the other end of the insert 53 and penetrates the wall of the insert. From the contact rivet 62, a line 64 leads to the resistor 47 along the outer surface of the insert 53 which resistor is installed in a cavity 65 of the handle 54 and the other end of which is connected with a contact rivet 66 which is provided, as an extension of the control light 48, in the insert 53. The head 68 of the contact rivet 66 faces the center contact 69 of the control light 48 at a distance, and the center contact can be applied to the head 68 of the contact rivet 66 by suppressing the control light 48 against the force of the conical spiral spring 60 so that the center contact forms, together with the head 69 of the contact rivet, the switch 49 of the wiring diagram according to FIG. 3. In addition, the capacitor 44 is connected with that end of the contact rivet 66 which protrudes into the cavity 65 of the handle 54, and the other end of the capacitor is conductively connected with the other pole of the battery through the contact bridge 63.

The switch 43 forms a cylindrical structural unit which is inserted into the grip 1 above the handle 54 from the rear and is kept in place in a bore of the grip through a screw 70. The switch can also be cemented in place in which case the screw merely serves the purpose of closing off the indentation 106 provided in the grip 1 and required for the wiring of the switch.

The structural unit forming the switch comprises a cylindrical casing 71 and a control 72 which can be moved in the longitudinal direction of this casing. The end of the control 72 protruding from the casing extends into the trigger guard 2 of the grip 1. The inner end of the control 72 is equipped with shift arms 73 which are equally distributed on the circumference pointing away from it, and is provided with faces 74 slanted toward the circumference. These shift arms are held between bars 75 of a control casing 76 which is inserted into the casing 71 of the switch 43. The faces 77 of the bars 75 are slanted in the same direction as the faces 74 of the shift arms 73. Following the inner end of the control 72, a cylindrical element 78 with arms 79 is provided which arms also engage between the bars 75 of the control casing and are located on the shift arms 73 of the control 72. The surfaces of the arms 79 of the cylindrical element facing the faces 74 of the shift arms 73 are slanted in such a manner that they adhere closely to the faces 74 of the shift arms. One of the arms of the cylindrical element 78 extends beyond the face of the cylindrical element not facing the control 72 and forms the setting contact 52 which interacts with mating contacts 80 provided at the base 81 of the casing 71.

Figure 2:
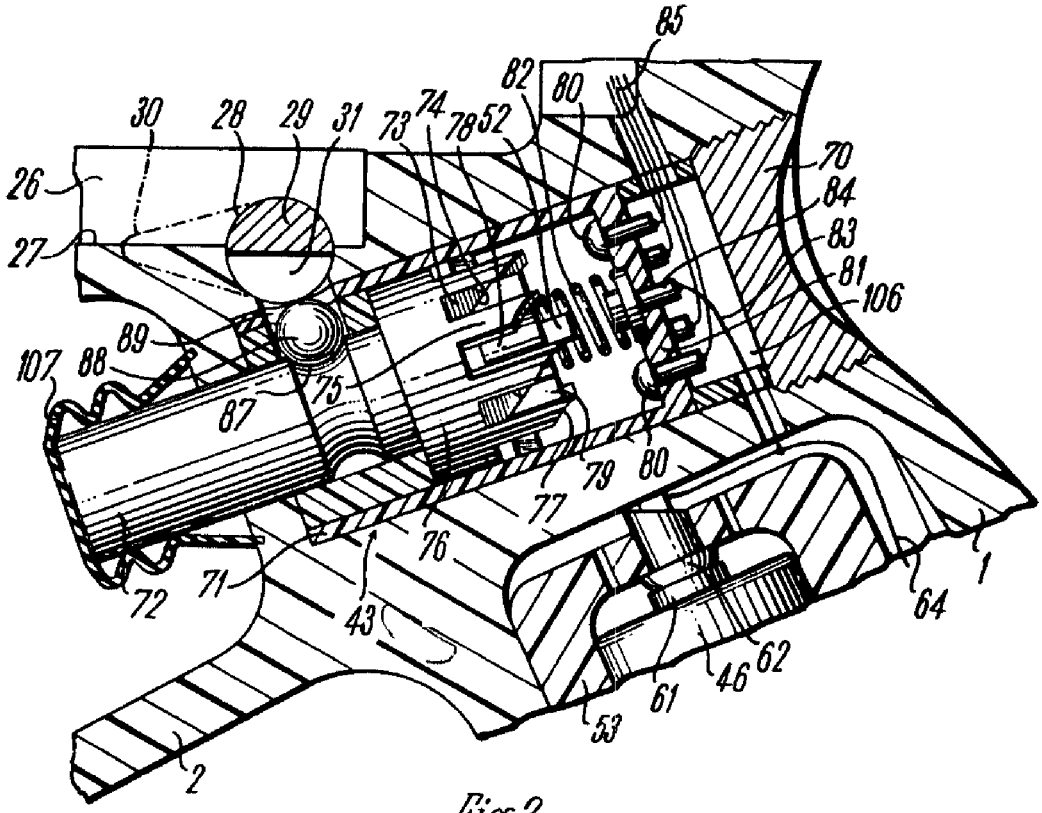
FIG. 2 is a cross-section, on an enlarged side, of the trigger switch of the firearm in accordance with FIGS. 1.

In the rest position of the switch 43 shown in FIG. 2, the cylindrical element 78 is kept at a distance from the base 81 provided with the mating contacts 80 through a compression coil spring 82. If the control 72 is suppressed, the cylindrical element 78, the arms 79 of which are located between the bars 75 of the control casing, is moved toward the base 81 in a straight line until its extended arm serving as setting contact 52 is applied to the mating contact 80 facing it. The switch then assumes a priming position 51 according to FIG. 3. In this priming position, a connection is established from one pole of the battery 46 through the contact bridge 63, line 83, the center contact 84 of the base 81, compression coil spring 82, cylindrical element 78, setting contact 52, and one of the mating contacts 80, via the associated conductor 85, to one of the contact pins 108 which are installed in a contact plate 109 facing the rear terminal disc 8 of the cylinder 3 which is inserted in a cover-type section 32 of the grip. The points of the conical contact pins 108 penetrate corresponding bores in the rear terminal disc 8, thereby touching conductors 110 which are provided, in an insulated condition, in the metal plugs 41 and lead to the center of the igniter caps 42. The circuit containing the capacitor 44 is closed through a line which connects a basin-shaped mating contact 111 provided in the contact plate 109 and receiving the rear end of the tension rod 9 with the collar 101 so that it is conductively connected with the edge of the igniter cap 42 through the rear terminal disc 8 and the metal plug 41, to the pole of the capacitor 44 to which the resistor 47 is attached. Consequently, a round is fired if the control 72 is suppressed. If the control is again released, the slant faces 74 and 77 provided at the arms 73 and the ends of the bars 75, in connection with the slant surfaces at the arms 79 of the cylindrical element, result in this element not returning to its prior position, but rotating about its longitudinal axis by an angle which equals the angle between its arms. Therefore, the cylindrical element is in the rest position after the control is released where its setting contact 52 faces the subsequent mating contact at the base 81 of the casing 71. In this simple manner, it is ensured that the switch is advanced by one position every time the switch 43 is activated so that one barrel is fired after the next.

In order to put the firearm on "safe", the control 72 is equipped with an annular groove 87 interacting with a ball 88 which ball is positioned in an indentation 89 in the casing 71 and interacting with the safety shaft 29. The ball 88 engages in the annular groove 87 and is kept in place in this indentation by the safety shaft 29 unless it assumes the position illustrated in the drawing in which the ball 88 is faced by the recess 31 of the safety shaft which provides the opportunity for the ball 88 to emerge from the annular groove 87 when the control 72 is suppressed.

It should also be mentioned that the firearm shown as the preferred embodiment is designed absolutely tight so that it is ready to fire even after having been submerged in water. For this purpose, not only are the above-mentioned detachable foil 14 at the muzzle of the barrel, and the rubber sleeve 107 at the trigger 72, provided, but the plugs 56 and 59 as well as the screw 70 have also been equipped with circumferential joints 112 through 114, and another circumferential joint 115 can be found between the rear terminal disc 8 of the cylinder, and the contact plate 109.

It is understood that the invention is not limited to the embodiment as presented, but that deviations from it are possible within the general scope of the invention. In particular, small arms can be designed, in accordance with the invention, which can be of any type and can be equipped with any number of barrels. Also, it is not absolutely indispensable that an electrical priming device be used, but a variety of different systems can be employed for this purpose. It is essential for the invention that the projectile is fired together with an element which follows it and is caught at the front end of the barrel, and thus tightly obturates the barrel so that no powder gases can escape from the barrel which might produce a bang. It is understood that the barrel has to be closed off essentially tight to the rear as well which is achieved, with the embodiment as presented, through the metal plugs 41 in which the conductors 110 consist of a flexible material which facilitates the penetration of the contact pins 108, and thus provides tolerance compensation. It is also possible to effect an absolutely tight sealing of this type by utilizing elastic, for instance, bellows-shaped contact elements.

It is understood that a connection between the sabot and the projectile has to be of such a nature that the projectile is easily released from the sabot when the sabot is caught, and it has to be ensured that the projectile is not subjected to breakdown torque when it is released from the sabot which might affect the firing accuracy of the weapon. Cementing, for instance, would have to be done very evenly in order to ensure that the projectile is released from the entire surface of the sabot at the same time. The same would also apply if the projectile were attached through clamping, or some other method.

What we claim is:

1. In the combination of a firearm and ammunition therefor, the improvement comprising: an ammunition round including a subcaliber projectile attached to the front end of a sabot, said projectile being separable from said sabot;

at least one barrel for said firearm;

said sabot having a cross-sectional area which substantially entirely fills the cross-sectional area of said barrel;

said barrel having lands adjacent its discharge end for effecting a sealing relationship with said sabot when said sabot together with its attached projectile are fired to thereby seal off said discharge end in a gas-proof manner;

a collar extending into the interior of said barrel at said discharge end to partially obturate said discharge end, said collar blocking said sabot upon the firing of a round but permitting the egress of said projectile; and a gas permeable plate normally blocking said barrel at its discharge end, said plate being so positioned as to be penetrated by said projectile only after said sabot has been blocked by said collar.

2. The combination of claim 1 in which said sabot is formed with a forward cylindrical portion of a size to fit into said collar.

3. The combination of claim 1 in which said sabot has a rear section which is of a size to engage with said lands in said barrel.

4. The combination of claim 1 in which said sabot further defines an interior cavity for holding a powder charge; and in which an igniter cap for said charge is provided in said barrel.

5. The combination of claim 1 in which said sabot is formed of a plastic material.

6. The combination of claim 1 in which said projectile is adhesively secured to said sabot.

7. The combination of claim 1 in which said sabot is provided with a cavity at its forward end, said projectile being inserted at least in part into said cavity.

8. The combination of claim 1 in which said barrel is provided with grooves, each having an arch-shaped base portion, adjacent ones of said grooves meeting along a sharp edge.

9. The combination of claim 1 in which said plate is formed of felt.

10. The combination of claim 1 in which the muzzle end of said barrel is covered by a thin detachable foil.

11. The combination of claim 1 which comprises a plurality of said barrels.

12. The combination of claim 11 in which several said barrels are joined together to form a cylinder which can be replaced as a unit.

13. The combination of claim 1 in which said barrel is detachable and replaceable with another barrel.

14. The combination of claim 13 in which each replacement barrel is provided with a cartridge comprising said projectile and said sabot.

15. The combination of claim 1 which further includes a trigger comprising an electrical switch, said ammunition round including an igniter cap, and means responsive to activation of said trigger for energizing said cap.

16. In the combination of a firearm and ammunition therefor, the improvement wherein:

an ammunition round includes a subcaliber projectile attached to the front end of a sabot, said projectile being separable from said sabot;

said firearm has a plurality of barrels joined together to form a cylinder which can be replaced as a unit, each of said barrels being normally provided with one said ammunition round;

said sabots have a cross-sectional area which substantially entirely fills the cross-sectional area of its associated barrel;

each said barrel has lands adjacent its discharge end for effecting a sealing relationship with said sabot when said sabot together with its attached projectile are fired to thereby seal off said discharge end in a gas-roof manner;

each said barrel has a collar extending into the interior thereof at its said discharge end to partially obturate said discharge end, said collar blocking said sabot upon the firing of a round but permitting the egress of said projectile; and said cylinder comprises a cylindrical element which is provided on a circle concentric with its axis with uniformly distributed bores which are axially parallel each for receiving one of said barrels, said barrels being retained by terminal discs and a tension rod, the front terminal disc also serving as said collars.

17. The combination of claim 16 in which said tension rod also comprises a sighting tube.

18. The combination of claim 16 in which said barrels are formed of a fiber glass-reinforced plastic.

19. The combination of claim 16 in which one said terminal disc is conductively connected with said tension rod, said one disc having bores for receiving contact pins, an end of said tension rod protruding beyond said one disc and having a collar which engages with a mating contact, switch means including a plurality of contacts which can be closed individually and in succession, said switch means connecting with said contact pins to select the barrel to be fired.

20. The combination of claim 19 which further includes a trigger and a rotary switch advanced by said trigger from one step to the next, said rotary switch comprising said switch means.

21. The combination of claim 18 in which each said barrel is provided with grooves, each having an arch-shaped base portion and with adjacent ones of said grooves meeting along a sharp edge; and in which each said sabot has a rear section which is of a size to engage with said sharp edges in the associated barrel.

22. The combination of claim 21 in which said sabot further defines an interior cavity for holding a powder charge; and in which an igniter cap for said charge is provided within said barrel.

23. In the combination of a firearm and ammunition therefor, the improvement comprising:

an ammunition round including a subcaliber projectile attached to the front end of a sabot, and an igniter cap, said projectile being separable from said sabot;

at least one barrel for said firearm;

said sabot having a cross-sectional area which substantially entirely fills the cross-sectional area of said barrel;

said barrel having lands adjacent its discharge end for effecting a sealing relationship with said sabot when said sabot together with its attached projectile are fired to thereby seal off said discharge end in a gas-proof manner;

a trigger comprising an electrical switch;

means, including a battery, responsive to the activation of said switch for energizing said cap;

an indicator light; and means for at times connecting said light in circuit with said battery to check the condition of said battery.

24. The combination of claim 23 including mounting means for said indicator light including spring means for normally urging said indicator light away from at least one conductive contact, whereby said indicator light can be pushed in opposition to the force of said spring means into contact with said conductive contact to place said indicator lamp in circuit with said battery.

* * * * *